US010450731B2

(12) United States Patent
McHale et al.

(10) Patent No.: US 10,450,731 B2
(45) Date of Patent: Oct. 22, 2019

(54) FAUCET-INTEGRATED TOUCH-FREE SOAP DISPENSING SYSTEMS

(71) Applicant: AS America, Inc., Piscataway, NJ (US)

(72) Inventors: James McHale, Hillsborough, NJ (US); Marin Marinov, East Brunswick, NJ (US); Walter Pitsch, Washington, NJ (US); Xiao Jing Ye, Edison, NJ (US)

(73) Assignee: AS America, Inc., Piscataway, NJ (US)

( * ) Notice: Subject to any disclaimer, the term of this patent is extended or adjusted under 35 U.S.C. 154(b) by 0 days.

(21) Appl. No.: 14/498,123

(22) Filed: Sep. 26, 2014

(65) Prior Publication Data

US 2015/0083748 A1 Mar. 26, 2015

Related U.S. Application Data

(60) Provisional application No. 61/882,960, filed on Sep. 26, 2013.

(51) Int. Cl.
*E03C 1/05* (2006.01)
*E03C 1/046* (2006.01)
(Continued)

(52) U.S. Cl.
CPC ..... *E03C 1/057* (2013.01); *E03C 1/046* (2013.01); *A47K 2210/00* (2013.01);
(Continued)

(58) Field of Classification Search
CPC ..... E03C 1/057; E03C 1/046; E03C 1/084; E03C 2001/0415; E03C 2001/0418;
(Continued)

(56) References Cited

U.S. PATENT DOCUMENTS 1,327,162 A * 1/1920 Knight ..... B67D 3/02 222/129.2
2,302,097 A * 11/1942 Beckman ..... A47L 17/00 134/103.1
(Continued)

FOREIGN PATENT DOCUMENTS

CN 2888217 Y 4/2007
DE 3938533 A1 5/1991
(Continued)

OTHER PUBLICATIONS

Integrated Pull-Down Kitchen Faucet with Soap Dispenser, Model: P188104LF-SD, http://www.peerlessfaucet.com/kitchen/prodduct/p1881041f-sd.html; Sep. 23, 2013 (unauthenitcated date).
(Continued)

*Primary Examiner* — Nicholas J. Weiss
(74) *Attorney, Agent, or Firm* — Morrison & Foerster LLP

(57) ABSTRACT

Faucet-integrated touch-free soap dispensing systems are provided. A soap dispenser is at least partially integrated with a faucet, and includes a proximity sensor, a dispensing unit, and a soap dispensing outlet. The dispensing unit includes a soap reservoir and a pump mountable below a deck that supports the faucet, and is communicatively coupled to the proximity sensor and fluidly coupled to the soap dispensing outlet via a soap tube.

15 Claims, 8 Drawing Sheets

(51) Int. Cl.
*E03C 1/084* (2006.01)
*E03C 1/04* (2006.01)

(52) U.S. Cl.
CPC ..... *E03C 1/084* (2013.01); *E03C 2001/0415* (2013.01); *E03C 2001/0418* (2013.01)

(58) Field of Classification Search
CPC ..... Y10T 137/9464; A47K 5/1217; A47K 2210/00; B05B 12/122
USPC .... 222/52, 145.5, 145.6, 135, 192; 137/562; 4/623
See application file for complete search history.

(56) References Cited

U.S. PATENT DOCUMENTS

| | | | | |
|---|---|---|---|---|
| 3,018,489 | A | 1/1962 | Saflarski | |
| 3,079,093 | A | 2/1963 | Bellows | |
| 3,091,402 | A * | 5/1963 | Palmer | E03C 1/046 222/144 |
| 3,639,920 | A * | 2/1972 | Griffin et al. | 4/623 |
| 3,917,172 | A * | 11/1975 | O'Hare | B05B 7/26 137/205.5 |
| 4,193,520 | A * | 3/1980 | Duffield | E03C 1/046 222/133 |
| 4,218,013 | A * | 8/1980 | Davison | B05B 7/12 137/889 |
| 4,219,158 | A * | 8/1980 | Lacy | E03C 1/046 239/222.19 |
| 4,607,793 | A * | 8/1986 | Eberle | E03C 1/046 239/318 |
| 4,625,896 | A | 12/1986 | Rocchelli | |
| 4,651,930 | A * | 3/1987 | Magaha, Jr. | B05B 7/2443 116/205 |
| 4,741,363 | A * | 5/1988 | Hu | E03C 1/057 137/607 |
| 4,933,080 | A * | 6/1990 | Rundzaitis | B01D 35/043 210/232 |
| 5,031,258 | A * | 7/1991 | Shaw | G08B 21/245 242/563 |
| 5,071,070 | A * | 12/1991 | Hardy | B05B 7/2472 222/132 |
| 5,114,048 | A * | 5/1992 | Minke | A47K 5/12 222/135 |
| D341,875 | S * | 11/1993 | Allen | D23/238 |
| 5,555,912 | A * | 9/1996 | Saadi | E03C 1/0404 137/801 |
| 5,765,242 | A | 6/1998 | Marciano | |
| 5,857,594 | A * | 1/1999 | Ozturk | E03C 1/046 222/185.1 |
| 6,000,626 | A * | 12/1999 | Futo | B05B 7/2464 239/333 |
| 6,125,482 | A * | 10/2000 | Foster | 4/623 |
| 6,202,980 | B1 * | 3/2001 | Vincent | E03C 1/05 251/129.04 |
| 6,370,713 | B2 | 4/2002 | Bosio | |
| 6,827,294 | B1 * | 12/2004 | Fan | A47K 5/1204 222/192 |
| 7,025,227 | B2 * | 4/2006 | Oliver | A47K 5/1217 222/180 |
| 7,364,053 | B2 * | 4/2008 | Ophardt | A47K 5/16 137/801 |
| 7,458,523 | B2 * | 12/2008 | Hyslop | E03C 1/0404 137/624.14 |
| 7,647,653 | B1 | 1/2010 | Catania | |
| 7,770,244 | B2 * | 8/2010 | Yeh | A47K 5/1205 222/192 |
| 7,819,289 | B2 * | 10/2010 | Willis | A47K 5/14 222/135 |
| 8,296,875 | B2 | 10/2012 | Loberger et al. | |
| 8,893,928 | B2 * | 11/2014 | Proper | B67D 7/76 222/173 |
| 2004/0211000 | A1 | 10/2004 | Buonocore | |
| 2006/0101575 | A1 | 5/2006 | Louis | |
| 2009/0100593 | A1 | 4/2009 | Lincoln et al. | |
| 2009/0152293 | A1 | 6/2009 | Sayers et al. | |
| 2010/0051719 | A1 * | 3/2010 | Carlucci | E03C 1/046 239/316 |
| 2011/0186161 | A1 | 8/2011 | Chen | |
| 2012/0125877 | A1 | 5/2012 | Padain et al. | |
| 2012/0261376 | A2 | 10/2012 | Padain et al. | |
| 2013/0291947 | A1 * | 11/2013 | Chandler et al. | 137/1 |
| 2014/0124540 | A1 * | 5/2014 | Ciavarella | A47K 5/14 222/190 |

FOREIGN PATENT DOCUMENTS

| | | | |
|---|---|---|---|
| DE | 4302073 | A1 | 7/1994 |
| DE | 19702315 | A1 | 8/1998 |
| DE | 19835514 | A1 | 2/2000 |
| DE | 20103766 | U1 | 6/2001 |
| DE | 20220319 | U1 | 12/2004 |
| DE | 102006062183 | A1 | 6/2008 |
| EP | 1683456 | A1 | 7/2006 |
| GB | 2136923 | A | 9/1984 |
| GB | 2138676 | A | 10/1984 |
| GB | 2211089 | A | 6/1989 |
| GB | 2431871 | A | 5/2007 |
| JP | 63-45877 | | 3/1988 |
| JP | 10-121534 | | 5/1998 |
| JP | 2006-161420 | | 6/2006 |
| JP | 2007-289216 | | 11/2007 |

OTHER PUBLICATIONS

Sonoma Pull-Down Kitchen Faucet with Integral Soap Dispenser, SKU: 905723, http://www.signaturehardware.com/product5723; Sep. 23, 2013 (unauthenitcated date).
Wholesale—Goose Neck Foam Soap Dispenser, Faucet Shape Soap Dispenser, Automatic Foam Sanitizer Dispenser, Automatic Faucet Soap Dispenser, http://www.dhgate.com/store/product/goose-neck-foam-soap-dispenser-faucet-shape/162794087.html; Sep. 23, 2013; (unauthenitcated date).
Sensor Activated Electronic Soap Dispenser, Sloan Optima Accessories, http://www.sloanvalve.com/Specifications/Optima_ESD-200_and_E250.pdf; Sep. 2011.
Lysol No-Touch Automatic Hand Soap Dispenser, http://www.lysol.com/products/hand-soaps/lysol-no-touch-automatic-hand-soap-dispenser/; at least as of Aug. 15, 2013 (unauthenitcated date).
International Search Report Application No. PCT/US2014/057704, dated Dec. 29, 2014.
Partial Supplementary European Search Report Application No. 14 84 7546, dated Apr. 25, 2017.
First Office Action dated Jan. 17, 2018, directed to CN Application No. 201480053361.0; 16 pages.
Office Action dated Jul. 28, 2017, directed to CA Application No. 2,925,608; 4 pages.
Extended European Search Report dated Aug. 8, 2017, directed to EP Application No. 14 84 7546.0; 10 pages.
Notice of Reasons for Rejection dated Aug. 28, 2017, directed to JP Application No. 2016-518160; 10 pages.
Notice of Reasons for Rejection dated Apr. 9, 2018, directed to JP Application No. 2016-518160; 8 pages.
Notice of Allowance dated Jan. 4, 2019, directed to JP Application No. 2016-518160; 6 pages.
Notice of Allowance dated Apr. 23, 2018, directed to CA Application No. 2,925,608; 1 page.
Second Office Action dated Jun. 27, 2018, directed to CN Application No. 201480053361.0; 10 pages.
Third Office Action dated Apr. 2, 2019, directed to CN Application No. 201480053361.0; 15 pages.

* cited by examiner

2 IN 1 AERATOR

FAUCET-INTEGRATED TOUCH-FREE SOAP DISPENSING SYSTEMS

CROSS-REFERENCE TO RELATED PROVISIONAL APPLICATION

This application claims the benefit of U.S. Provisional Application No. 61/882,960, filed on Sep. 26, 2013, the disclosure of which is hereby incorporated by reference herein in its entirety.

FIELD OF THE INVENTION

The present invention generally relates to faucets and touch-free soap dispensers.

BACKGROUND OF THE INVENTION

Conventional soap dispensers include fixed, counter-top integrated units with replaceable soap receptacles and portable units, such as bottles with soap-dispensing spouts. One conspicuous disadvantage of such soap dispensers is that they require a person to touch a part of the dispenser that may harbor the very types of germs the person wishes to eliminate. Touch-free soap dispensers that use proximity sensors to determine when to dispense soap are currently available. However, such units, like their typical counterparts, are separate products that stand on the countertop or have to be mounted separately through the deck of the countertop.

SUMMARY OF THE INVENTION

Generally speaking, it is an object of the present invention to provide a touch-free soap dispensing system integrated with a faucet.

The faucet-integrated touch-free soap dispensing system embodiments disclosed herein can include an above-deck sensing mechanism and a soap dispensing (outlet) nozzle that can be fully or partially integrated with the faucet body. A dispensing unit that houses a soap reservoir, power source, and pumping mechanism can be mounted below the deck (e.g., countertop or tub deck) and can be fluidly connected to the soap dispensing nozzle via a soap tube. In other implementations, one or more of the components of the dispensing unit may be mounted above-deck.

Still other objects and advantages of the present invention will in part be obvious and will in part be apparent from the specification.

The present invention accordingly comprises the features of construction, combinations of elements, and arrangements of parts, all as exemplified in the constructions herein set forth, and the scope of the invention will be indicated in the claims.

BRIEF DESCRIPTION OF THE DRAWINGS

For a fuller understanding of the inventive embodiments, reference is had to the following description taken in connection with the accompanying drawings in which.

DETAILED DESCRIPTION OF THE PREFERRED EMBODIMENTS

Figure 1:
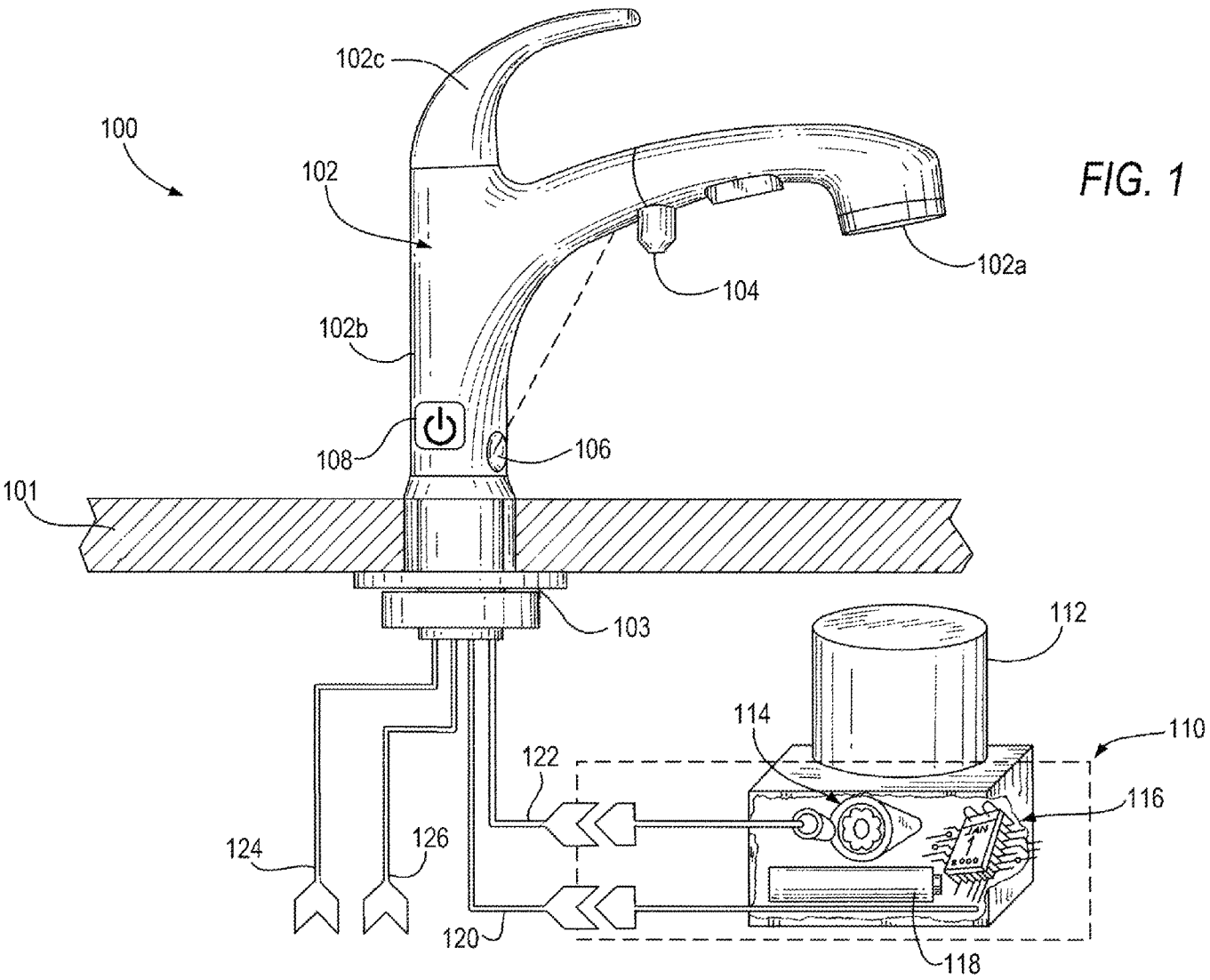
FIG. 1 shows a schematic view of a faucet-integrated touch-free soap dispensing system in accordance with some embodiments of the present invention.

Referring now to the drawing figures, FIG. 1 shows a schematic view of a faucet-integrated touch-free soap dispensing system 100 in accordance with some embodiments of the present invention. System 100 can include a faucet 102 that includes a soap dispensing nozzle 104, a sensor 106, and an on/off switch 108. System 100 can further include a dispensing unit 110 that houses a soap reservoir 112, a pump 114, a controller 116, and a power source (e.g., battery) 118. Sensor 106 can sense when a hand (or other object, such as, for example, a dirty dish) is placed in the area below the spout of faucet 102 and can trigger automatic touch-free dispensing of soap via soap dispensing nozzle 104.

As depicted in FIG. 1, faucet 102 may be a single handle kitchen faucet; however, it should be understood that faucet 102 can be any suitable type of faucet, such as, for example, a mechanically operated dual control or single control faucet, a pull-out faucet, a pull-down faucet, or a hands-free, electronic sensor faucet for the kitchen or the lavatory (i.e., wash basin, or tub/shower).

Faucet 102 can include a faucet body 102*b* that extends from a mounting deck (e.g., countertop) 101 as well as a spout 102*a* for dispensing water. Faucet 102 can be mounted to countertop 101 using any suitable mounting hardware, depicted in FIG. 1 as mounting hardware 103. Manual water control 102*c* may be mechanically coupled to a mixing valve for adjusting water temperature and controlling the flow of water through faucet 102.

Soap can be dispensed via soap dispensing nozzle 104, which, as depicted in FIG. 1, may be integrated into the spout of faucet 102. Integrating soap dispensing nozzle 104 into the spout of faucet 102 can be particularly advantageous as soap can be dispensed automatically when the user places his or her hands in range of sensor 106 in the area beneath the spout. In other embodiments, however, soap dispenser 104 can be located at any other convenient location of faucet 102 (e.g., at the side of the main body of the faucet as described below with respect to FIG. 3 or in the spout as described below with respect to FIG. 5).

Sensor 106 may be any suitable sensor that can sense the presence of an object in close proximity, such as, for example, a capacitive sensor, an inductive sensor, a laser rangefinder, a magnetic sensor, or an infrared sensor. Sensor 106 may be placed in a suitable location on or near faucet 102 (e.g., the main body of faucet 102) such that soap is dispensed via soap dispensing nozzle 104 when the user's hands come within a preselected distance (e.g., 6") of sensor 106. For example, when soap dispensing nozzle 104 is integrated into the spout of faucet 102, sensor 106 may be located on the main body of faucet 102.

On/off switch 108 may be included within system 100 in order to toggle on and off the touch-free soap dispensing feature. To that end, on/off switch 108 may be communicatively coupled to one or more elements of dispensing unit 110 (e.g., controller 116 and/or battery 118) via a communications line 120, which may be realized using electrical wiring with suitable connectors and/or a wireless connection. In some embodiments, on/off switch 108 may be provided on the main body of faucet 102. However, on/off switch may be placed in any other convenient location, including on the spout of faucet 102, on countertop 101, or on dispensing unit 110.

According to some embodiments, dispensing unit 110 can be mounted below deck 101 in order to maximize deck space. In other embodiments, however, one or more elements of dispensing unit 110 may be disposed above or partially above deck 101. Dispensing unit 110 can be configured for easy attachment to the faucet shank or to a wall or other suitable structure. A soap tube 122 of sufficient length fluidly coupled between dispensing unit 110 and faucet 102 can accommodate a variety of mounting locations.

Soap reservoir 112 of dispensing unit 110 may be a fixed bottle or other receptacle that can be refilled with liquid soap, such as via an aperture formed near the top of soap reservoir 112, for example. In other embodiments, dispensing unit 110 may accept pre-filled soap bottles via a suitable docking mechanism, such as a threaded coupling, one or more clips, or a receptacle designed to hold soap reservoir 112 with the assistance of gravity. When sensor 106 senses the presence of an object within a preselected distance, pump 114 can pump the liquid soap from soap reservoir 112 and out of soap dispensing nozzle 104 via soap tube 122. Pump 114 may be a conventional hydraulic pump or a piezo-hydraulic pump, for example.

Controller 116 can receive signals from various elements of system 100 to determine if and when to dispense soap. For example, controller 116 can receive signals from sensor 106 that indicate whether or not an object is within the preselected distance from sensor 106 that triggers dispensing of soap. When controller 116 receives such a signal, it can transmit a signal instructing pump 114 to begin pumping soap from soap reservoir 112 out of soap dispensing nozzle 104. Controller 116 may also receive signals from on/off switch 108, and, in response, toggle on and off power to sensor 106 and/or power to pump 114. Alternatively or additionally, on/off switch 108 may toggle on and off power to controller 116.

Electrical power for operating elements of system 100, including sensor 106, pump 114, and controller 116, may come from any suitable source or combination of sources. For example, power may be supplied by battery 118, which may be located within dispensing unit 110, and/or from an AC or DC power source. Communications line 120, for relaying electrical power and/or signals between sensor 106, on/off switch 108, and dispensing unit 110, can be run to faucet 102 alongside soap tube 122, hot water supply line 125, and cold water supply line 126.

Figure 2:
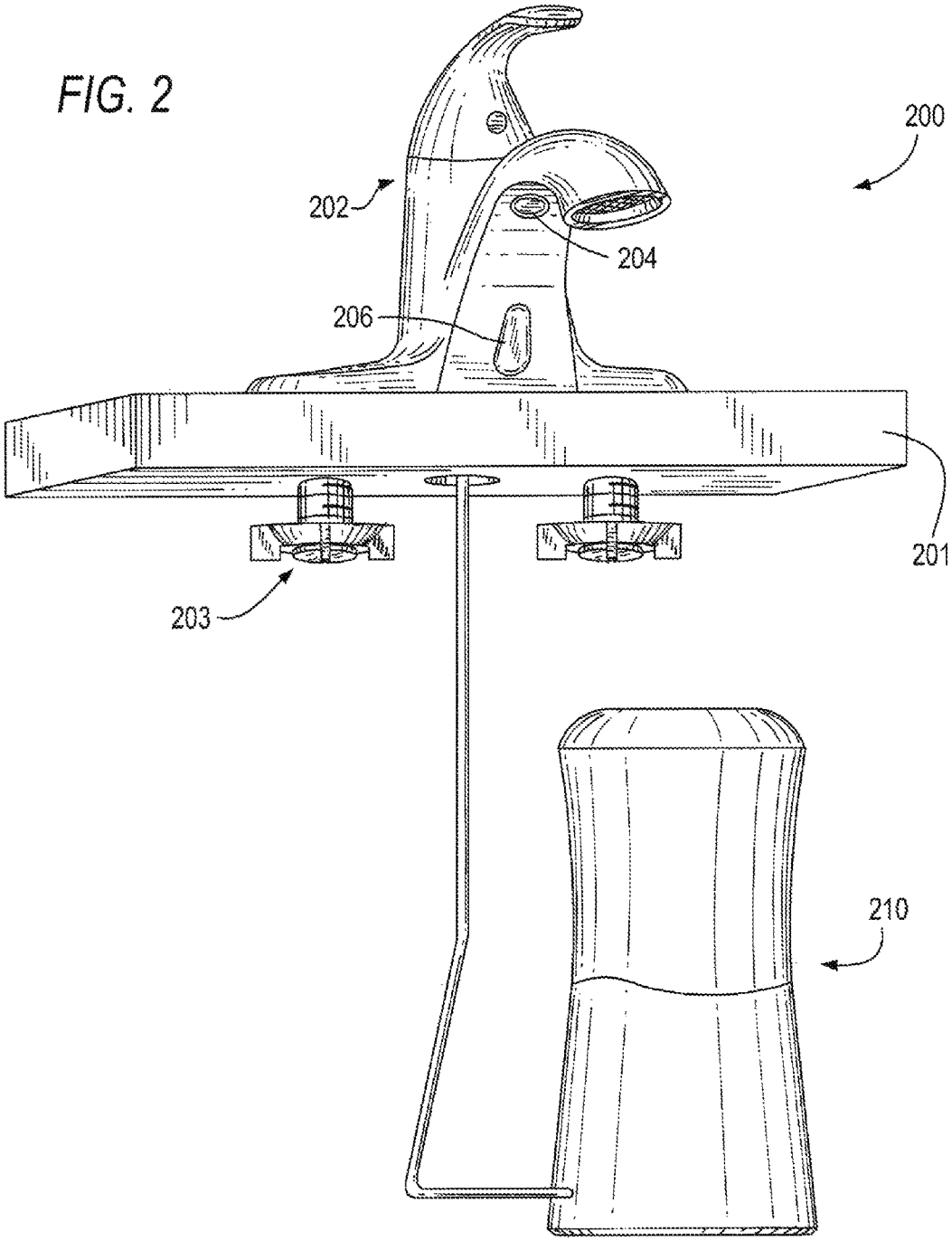
FIG. 2 shows a perspective view of a lavatory faucet with an integrated touch-free soap dispensing system in accordance with some embodiments.

FIG. 2 shows a perspective view of a lavatory faucet with integrated touch-free soap dispensing system 200 in accordance with some embodiments. System 200 can include faucet 202 with an integrated soap dispenser nozzle 204 and a sensor 206. A dispensing unit 210, which can include a soap reservoir, a pump, a controller, and a battery, and which can be connected to the faucet via a soap tube and electrical wiring with connectors, can be mounted to the underside of a deck 201. Mounting hardware 203 can be provided to mount faucet 202 to the top side of deck 201.

Figure 3:
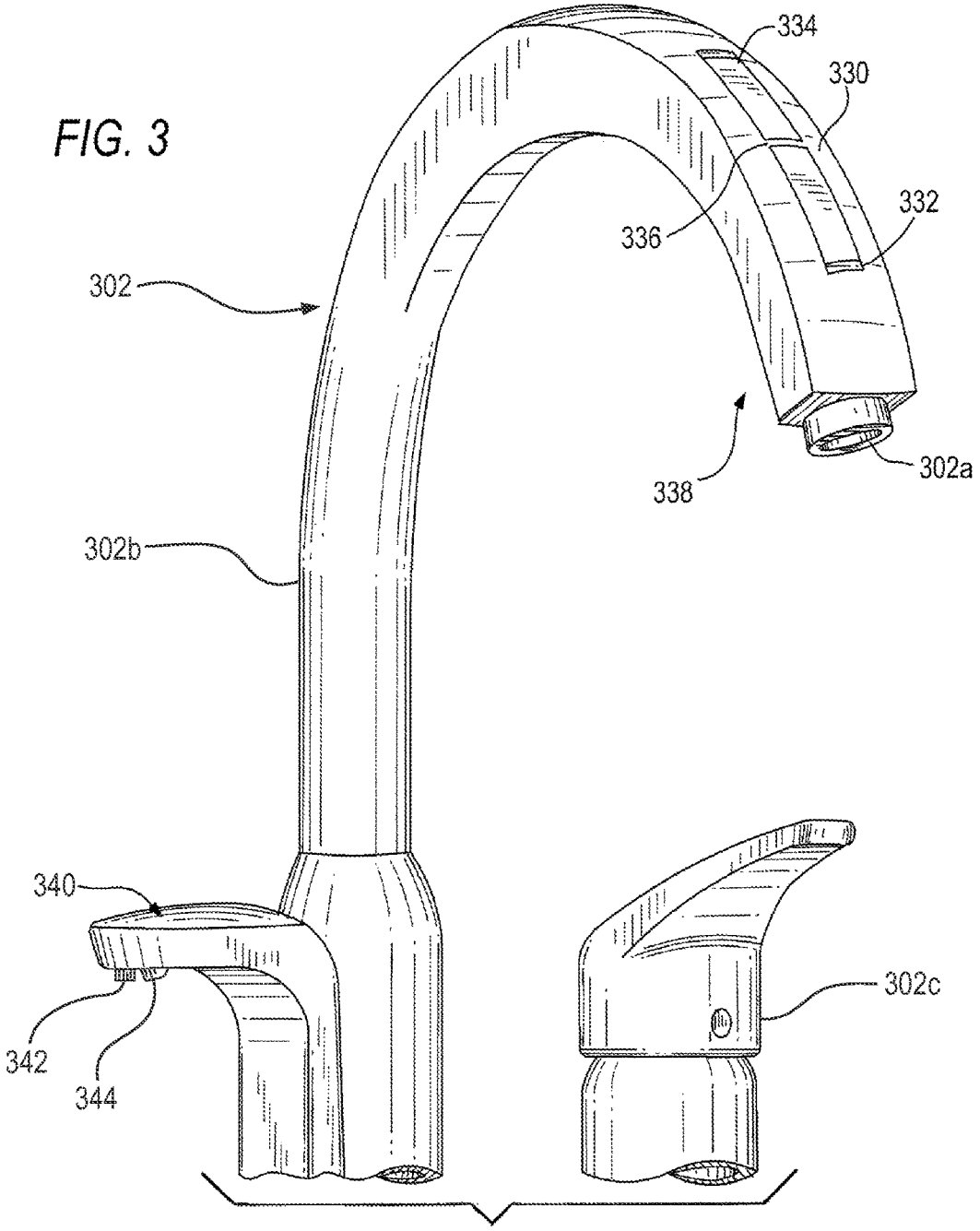
FIG. 3 shows a kitchen faucet with an integrated touch-free soap dispensing system in accordance with some embodiments.

FIG. 3 shows a kitchen faucet-integrated touch-free soap dispensing system 300 in accordance with some embodiments. System 300 may include kitchen faucet 302, with both electronic water control 330 and manual water control 302*c*, and electronic soap dispenser 340. System 300 may be mounted on a countertop and may be coupled to a dispensing unit mounted under the countertop (e.g., dispensing unit 110 of FIG. 1).

Electronic soap dispenser 340 may incorporate a sensor 342 and a soap dispensing nozzle 344, which may correspond to sensor 106 and soap dispensing nozzle 104 of FIG. 1, respectively. Electronic soap dispenser 340 can project out of a side of the main body of faucet 302 to provide a conveniently placed integrated, touch-free soap dispensing unit. In some embodiments, the housing of electronic soap dispenser 340 may be rotatably coupled to faucet 302 to allow a user to reposition sensor 342 and nozzle 344 as desired.

Electronic water control 330 can be communicatively coupled to a controller, which can adjust an electronically controllable mixing valve of faucet 302 in order to control the temperature of the water dispensed from the spout. The controller may be the controller of the dispensing unit that also controls operation of electronic soap dispenser 340 (e.g., controller 116 of FIG. 1) or a separate controller provided for controlling the electrically controllable mixing valve. Alternatively, the electronic water control can be used to control the flow of mixed water that has already passed through the manual mixing valve 302*c*, in which case, only on/off control is provided electronically and temperature is determined by manual adjustment of the mixing valve.

In some embodiments, electronic water control 330 may employ one or more distance sensors that can sense the position of a user's hand in proximity to faucet 302. The one or more distance sensors may permit the user to adjust the temperature of water by detecting the position of the user's hand (or other suitable object) relative to cold-side indicator 332 and hot-side indicator 334. Temperature indicator 336, which can be embodied as a digital display or mechanical indicator (e.g., a thermometer), can give the user an indication of the selected water temperature. In some embodiments, proximity sensor 338 can be provided (e.g., on the underside of faucet body 302 near spout 302*a*) that can sense the presence of a user's hands under the faucet and initiate the dispensing of water from spout 302*a*.

In embodiments in which the faucet is provided with an electronic water control and an electronic soap dispenser, such as the embodiment depicted in FIG. 3, the controller (e.g., controller 116 of FIG. 1) may be programmed to dispense soap and water in one or more choreographed patterns. For example, in one pattern, the controller may instruct the pump and electrically controllable mixing valve to dispense only water for a first interval (e.g., two seconds), only soap for a second interval (e.g., one second), and only water for a third interval (e.g., ten seconds or until the user's hand is no longer sensed in proximity to the sensor). In a second example, the controller may instruct the pump and electrically controllable mixing valve to dispense water and soap together for a first interval (e.g., two seconds) and only water for a second interval (e.g., ten seconds or until the user's hand is no longer sensed in proximity to the sensor). In some embodiments, a user may be permitted to choose from a number of predefined patterns or to define a custom pattern for dispensing the water and soap.

In embodiments in which an electronically controllable mixing valve is not provided, the controller may control the dose of soap to be provided. For example, when a user's hand is detected in proximity to the sensor, the controller may instruct the pump to dispense soap for a predefined interval (e.g., two seconds). At any time, the user may manually dispense water from the faucet using a manual water control mechanism, such as manual water controller 302*c*, which may be provided to manually adjust the mixing valve of faucet 302.

Figure 4B:
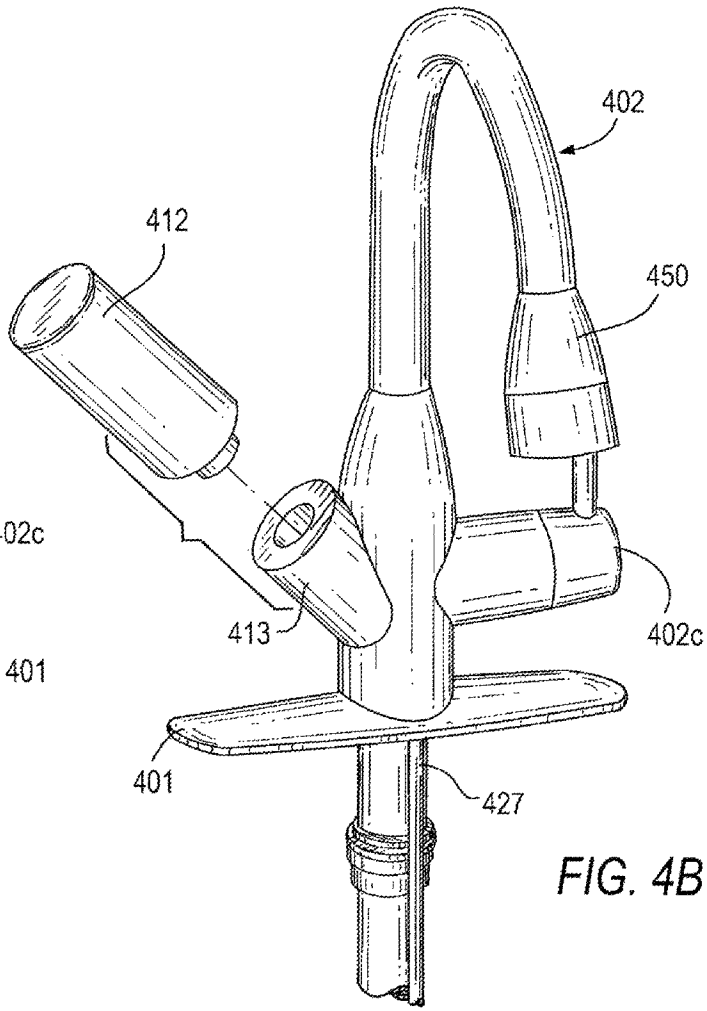
FIGS. 4A and 4B show perspective views of a faucet-integrated touch-free soap dispensing system, in accordance with some embodiments.
Figure 4A:
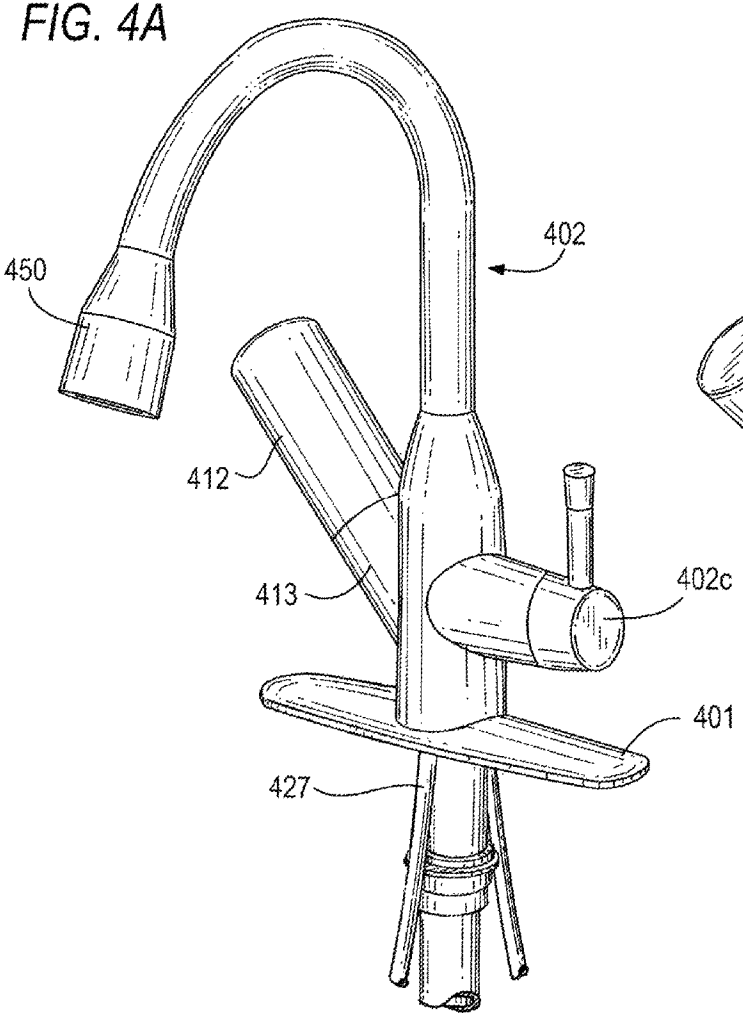

FIGS. 4A and 4B show perspective views of yet another faucet-integrated touch-free soap dispensing system 400, in accordance with some embodiments. In particular, FIGS. 4A and 4B show soap reservoir 412 fluidly mounted on faucet 402 above countertop 401. Soap reservoir 412 may be removably coupled to faucet 402 using docking mechanism 413, which may include a threaded coupling, one or more clips, or a receptacle designed to hold soap reservoir 412 with the assistance of gravity. Above-deck mounting of soap reservoir 412 may simplify changing and refilling the soap for system 400.

Figure 7:
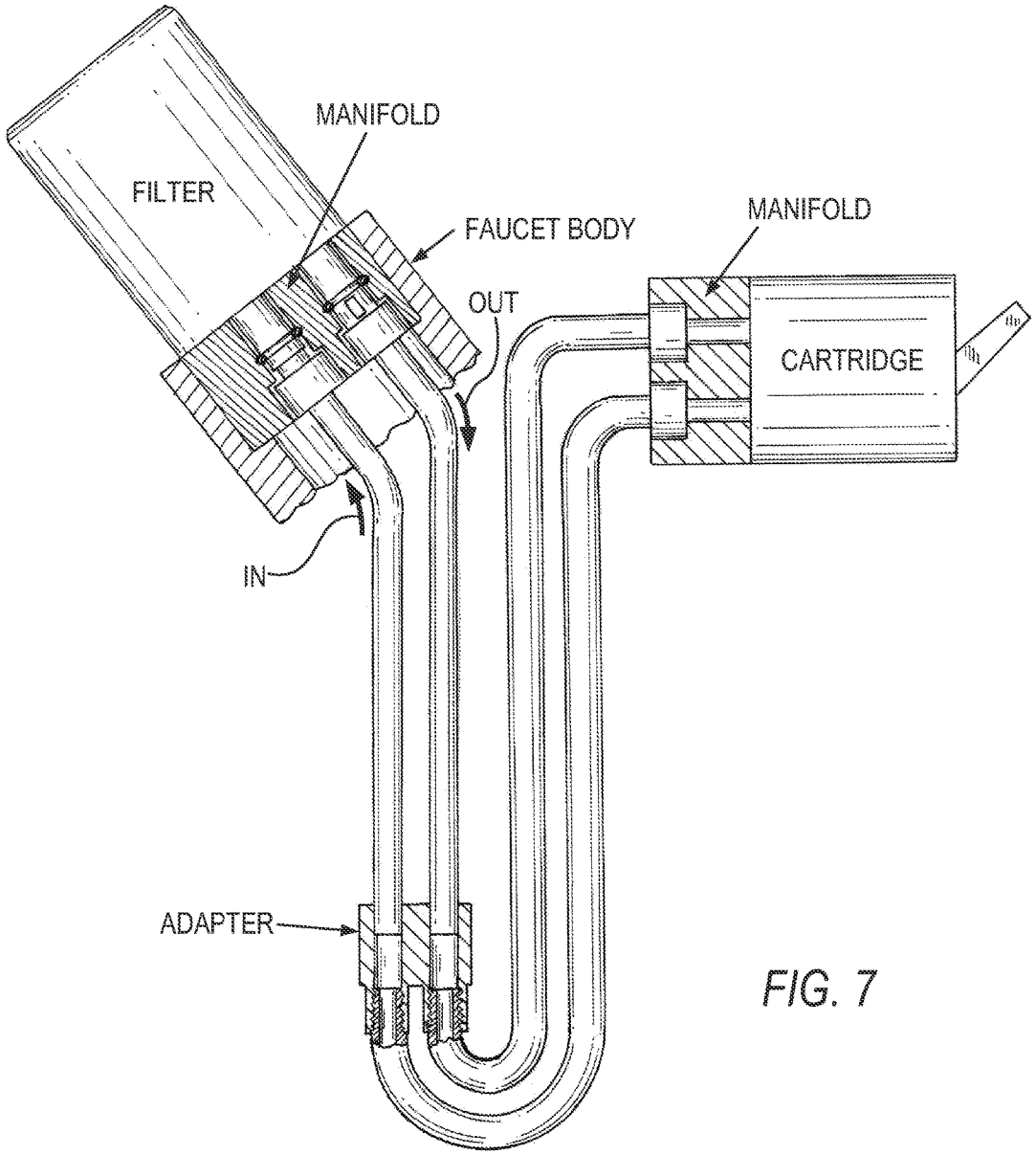
FIG. 7 shows an exemplary water filtration system that can be incorporated in embodiments of the inventive faucet-integrated touch-free soap dispensing system.

A water filtration system can also be provided in faucet 402 in similar fashion (see, e.g., FIG. 7).

Figure 5:
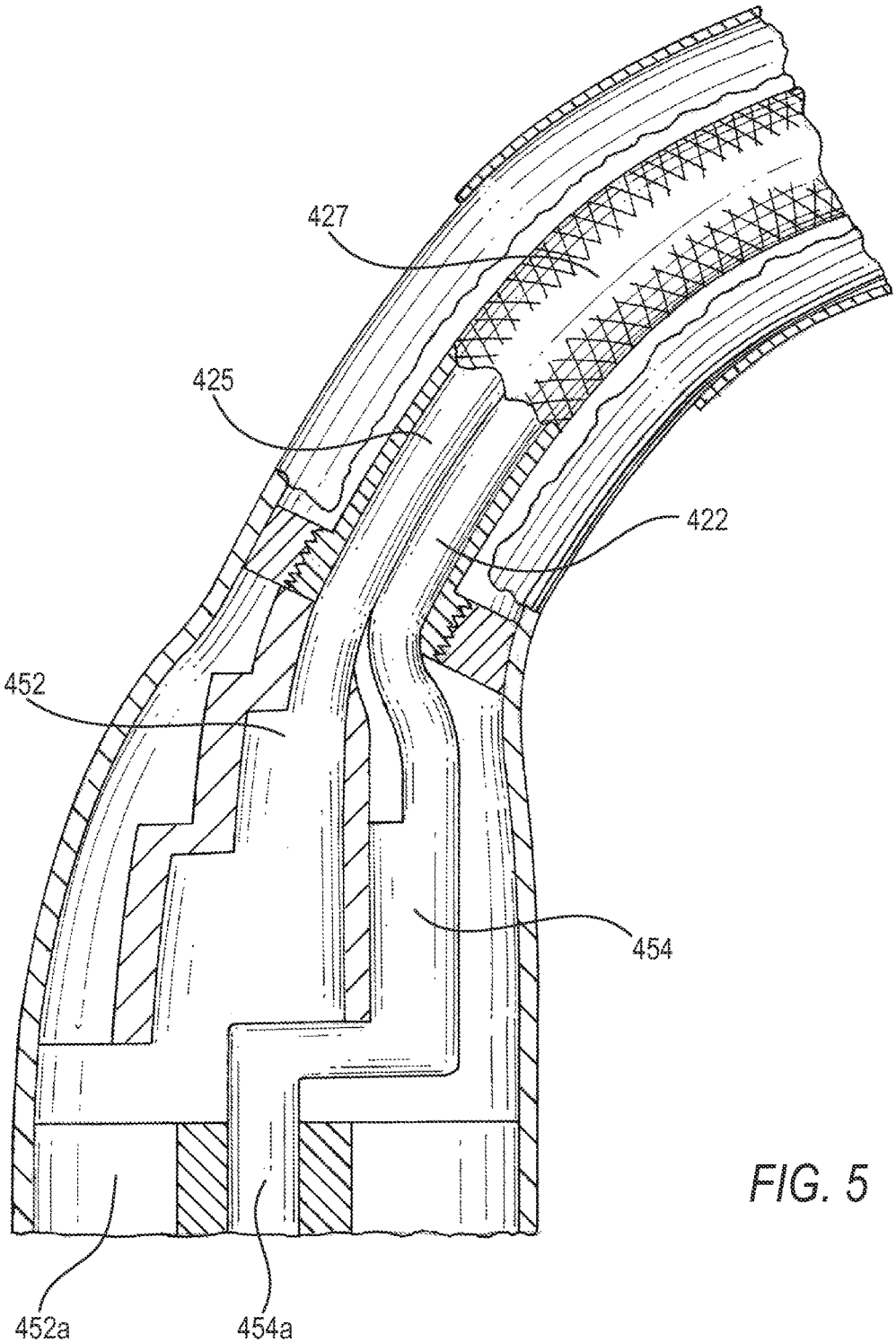
FIG. 5 shows a cross-sectional view of a spray head, in accordance with some embodiments.

In some embodiments, soap may be dispensed from a soap dispenser located in spray head 450 of faucet 402. Accordingly, faucet 402 may be configured to dispense soap and water as illustrated in FIG. 5, which shows a cross-sectional view of spray head 450, in accordance with some embodiments. Spray head 450 can include internal conduits 452 and 454 for respectively conveying water and soap out of outlets 452*a* and 454*a*. Internal conduits 452 and 454 may be fluidly coupled, respectively, to water line 425, which may convey water from a mixing valve to spray head 450, and soap tube 422, which may convey liquid soap from the soap reservoir to spray head 450. In some embodiments, water line 425 and soap tube 422 may be run together through the faucet body in hose 427. In other embodiments, water line 425 and soap tube 422 may be run separately through the faucet body without being confined in a hose.

Outlets 452*a* and 454*a* may be apertures located at the end of spout 450 for dispensing water and soap from faucet 402 and may be arranged in any suitable layout. As depicted in FIG. 5, outlet 452*a* can annularly surround outlet 454*a*; however, other layouts, such as a side-by-side arrangement, for example, are explicitly contemplated.

Figure 8:
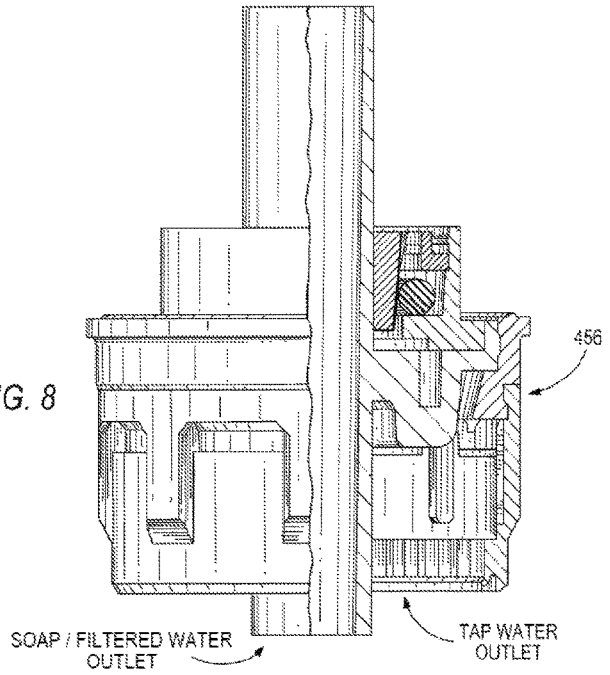
FIG. 8 shows an exemplary 2-in-1 aerator that can be incorporated in embodiments of the inventive faucet-integrated touch-free soap dispensing system.

In some embodiments, outlets 452*a* and 454*a* direct water and soap into a 2-in-1 aerator 456 (see, e.g., FIG. 8), which may be disposed at the end of spray head 450. In various embodiments, 2-in-1 aerator 456 may be a separate component coupled to spray head 450 (e.g., with a press-fit or a threaded coupling) or 2-in-1 aerator 456 may be integrally formed with spray head 450. 2-in-1 aerator 456 may provide a number of useful functions for spray head 450.

Figure 8A:
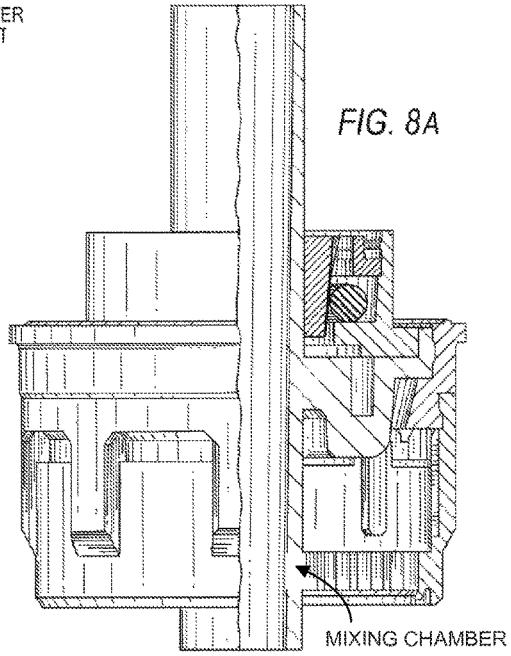
FIG. 8A shows an exemplary 2-in-1 aerator with mixing chamber that can be incorporated in embodiments of the inventive faucet-integrated touch-free soap dispensing system.

In some embodiments, 2-in-1 aerator 456 can include a leadthrough that can allow soap to be dispensed directly from outlet 454*a* without allowing the soap to mix with water being dispensed from outlet 452*a*. In these embodiments, a screen of the aerator, which may be a wire mesh screen disposed at an outlet end of 2-in-1 aerator 456 may include an aperture corresponding to outlet 454*a* to allow soap to flow from outlet 454*a* without interacting with the mesh screen. In other embodiments, 2-in-1 aerator 456 can include a mixing chamber (see, e.g., FIG. 8A) between outlets 452*a* and 454*a* and the screen. In these embodiments, soap and water may be mixed in the mixing chamber before being dispensed from spray head 450.

In some embodiments, faucet 402 can be a pull-out type faucet that permits spray head 450 to be pulled away from the faucet body. Hose 427 can be slack when spray head 450 is in its docked position relative to faucet 402. This slack length can allow spray head 450 to be pulled away from faucet 402 in its extended position. It should be understood, however, that water line 425 and soap tube 422 may be routed through hose 427 regardless of whether faucet 402 is configured as a pull-out faucet or a standard fixed faucet.

Figure 6:
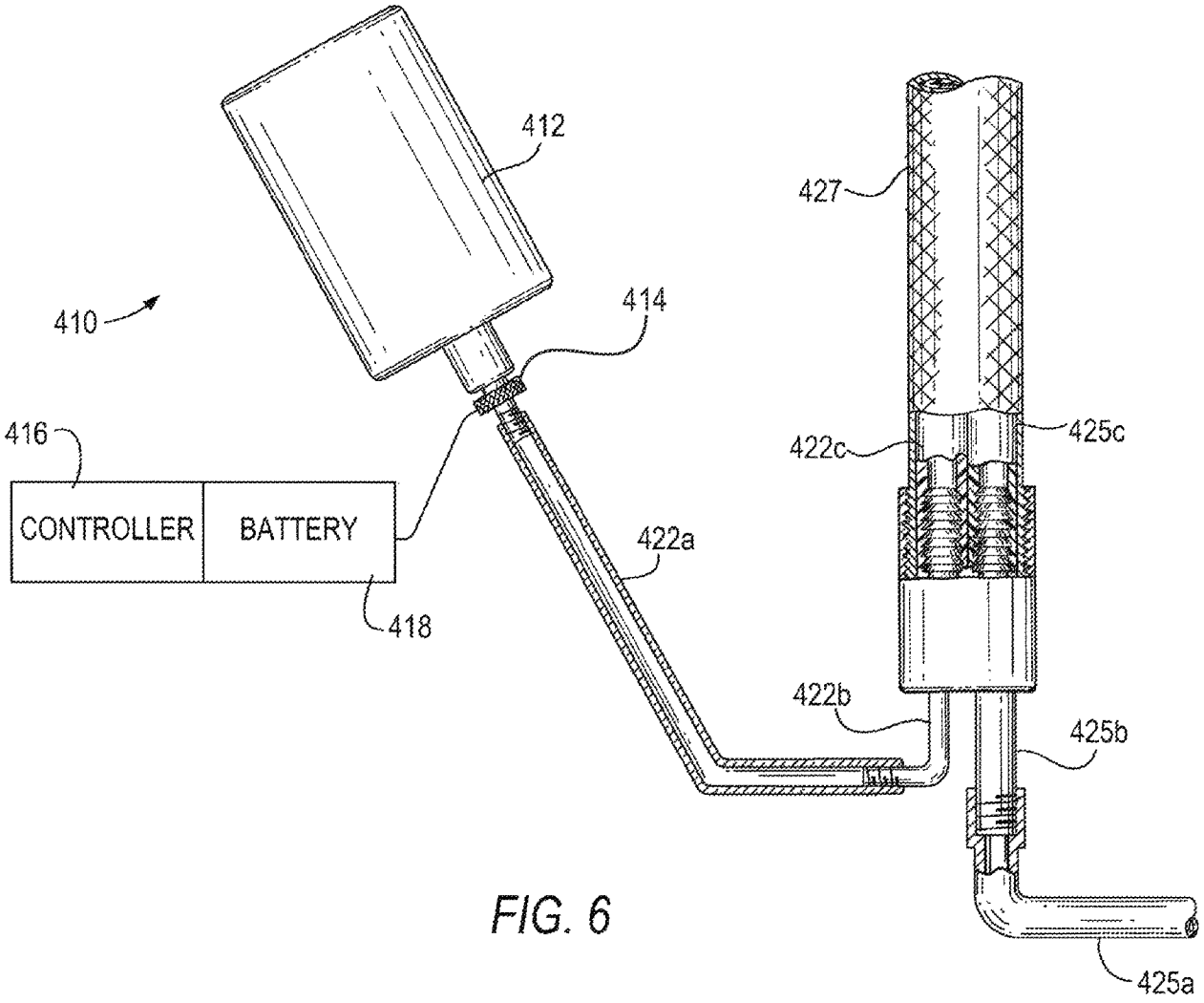
FIG. 6 shows a schematic view of a portion of a faucet-integrated touch-free soap dispensing system, in accordance with some embodiments.

FIG. 6 shows a schematic view of a portion of a faucet-integrated touch-free soap dispensing system 400, in accordance with some embodiments. In particular, FIG. 6 depicts how water line 425 and soap tube 422 can be routed through hose 427 of a pull-out style or fixed faucet. Pump 414 (e.g., a piezoelectric micro pump) may be coupled to an aperture of soap reservoir 412 to pump soap through soap tube 422 when instructed by controller 416 communicatively coupled thereto. Battery 418 or another suitable power source can provide the necessary power for controller 416 and pump 414.

Soap tube 422 can include first section 422*a*, coupling 422*b*, and third section 422*c*. First section 422*a* may be fluidly coupled at a first end to pump 414 and at a second end to third section 422*c* via coupling 422*b*. The couplings of the various sections of soap tube 422 may be made using one or more frictional couplings, threaded couplings, or clamps, for example. Similarly, water line 425 can include first section 425*a*, coupling 425*b*, and third section 425*c*. First section 425*a* may be fluidly coupled at a first end to a mixing valve of faucet 402 and at a second end to third section 425*c* via coupling 425*b*.

Accordingly, the inventive embodiments eliminate the need for a separate mechanical or touch-free soap dispenser. Integrating the soap dispenser with a faucet simplifies everyday tasks by eliminating manual pumping and providing soap at the location where it is needed most—in close proximity to the water outlet. Not only do the inventive embodiments save water, energy and time, they also free up valuable kitchen and bath countertop and deck real estate.

Although the disclosed embodiments can operate mechanically, without the use of electricity, embodiments of the present invention can be implemented in the form of control logic in software or hardware or a combination of both. For example, particular embodiments can be implemented by using application specific integrated circuits or programmed logic circuits. In general, the functions of particular embodiments can be achieved by any suitable means as is known in the art. Communication or transfer of data or instructions may be wired, wireless, or by any other suitable means. Also, elements of the inventive embodiments can be enabled or disabled as is useful in accordance with a particular application.

Furthermore, it should be understood that the aspects, features and advantages made apparent from the foregoing are efficiently attained and, since certain changes may be made in the disclosed inventive embodiments without departing from the spirit and scope of the invention, it is intended that all matter contained herein shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A faucet-integrated soap dispensing system, comprising:

a faucet including a body, the body having an integral docking mechanism branching therefrom receiving a removable soap reservoir;

a water supply tube in the body fluidly coupled to a water source;

a soap tube independent of the water supply tube, the soap tube at least partially disposed in the docking mechanism and configured to detachably couple to the soap reservoir; and a spray head movable between a docked position and an undocked position, wherein the sprayhead has a water outlet and a soap dispensing outlet, the water outlet being configured to fluidly couple to the water supply tube and the soap dispensing outlet being configured to fluidly couple to the soap tube, wherein the water supply tube and the soap tube are both enclosed by a hose and the docking mechanism comprises a coupling mechanism configured to hold the removable soap reservoir to the body of the faucet, and wherein the docking mechanism is configured to receive the removable soap reservoir at the same time the removable soap reservoir fluidly couples to the soap tube.

2. The system of claim 1, wherein the body further includes an arm branching therefrom in a direction substantially orthogonal to a longitudinal axis of the body, the arm being disposed on the body substantially opposite the docking mechanism and configured to accommodate a manual water control handle.

3. The system of claim 1, wherein the docking mechanism branches from the body at an angle between a longitudinal axis of the body and about 90 degrees with respect to the axis.

4. The system of claim 1, further comprising:

a proximity sensor;

a controller communicatively coupled to the proximity sensor via a communications line; and a pump fluidly coupled to an aperture in the soap reservoir, the controller being configured to cause the pump to pump soap from the soap reservoir, through the soap tube and to the soap dispensing outlet, when an object is detected within a predetermined distance of the proximity sensor.

5. The system of claim 4, further comprising a power source configured to provide electrical power to the controller and the pump.

6. The system of claim 1, wherein the spray head comprises:

a first internal conduit fluidly coupled to the water supply tube; and a second internal conduit fluidly coupled to the soap tube.

7. The system of claim 1, wherein one of:

the water outlet annularly surrounds the soap dispensing outlet; and the water outlet and the soap dispensing outlet are arranged substantially side-by-side.

8. The system of claim 1, further comprising an aerator disposed at an end of the spray head proximate the water outlet and the soap dispensing outlet.

9. The system of claim 8, wherein the aerator comprises a leadthrough fluidly coupled to the soap dispensing outlet for dispensing soap without mixing the soap with water being dispensed from the water outlet.

10. The system of claim 1, further comprising a controller; an electronic soap dispenser including a proximity sensor communicatively coupled to the controller; and an electronic water control including touch-free control elements communicatively coupled to the controller for adjusting a temperature of water dispensed from the faucet, the controller being configured to cause soap to be discharged from the soap dispensing outlet and water to be discharged from the water outlet in at least one choreographed pattern.

11. The system of claim 10, wherein the at least one choreographed pattern comprises a pattern in which only water is initially discharged for a first interval, only soap is then discharged for a second interval, and only water is discharged thereafter for one of a third interval and until an object is no longer detected by the proximity sensor.

12. A faucet-integrated water filter system, comprising:

a faucet including a body, the body having an integral docking mechanism branching therefrom receiving a removable water filter;

a water supply tube in the body fluidly coupled to a water source;

a filtered water tube at least partially disposed in the docking mechanism and configured to detachably couple to the water filter; and a spray head movable between a docked position and an undocked position, wherein the sprayhead has a water supply outlet and a filtered water outlet, the water supply outlet being configured to fluidly couple to the water supply tube and the filtered water outlet being configured to fluidly couple to the filtered water tube, wherein the water supply tube and the filtered water tube are both enclosed by a hose and the docking mechanism comprises a coupling mechanism configured to hold the removable water filter to the body of the faucet, and wherein the docking mechanism is configured to receive the removable water filter at the same time the removable water filter fluidly couples to the filtered water tube.

13. The system of claim 1, wherein the hose comprises slack length configured to permit the spray head to move between the docked position and the undocked position relative to the faucet body.

14. The system of claim 12, wherein the hose comprises slack length configured to permit the spray head to move between the docked position and the undocked position relative to the faucet body.

15. The system of claim 1, wherein the coupling mechanism is one or more of a threaded coupling, a clip, or a receptacle configured to hold the soap reservoir with the assistance of gravity.

* * * * *